US005439414A

United States Patent [19]

Jacob

[11] Patent Number: 5,439,414

[45] Date of Patent: Aug. 8, 1995

[54] NETWORKED FUME HOOD MONITORING SYSTEM

[75] Inventor: Steven D. Jacob, Roselle, Ill.

[73] Assignee: Landis & Gyr Powers, Inc., Buffalo Grove, Ill.

[21] Appl. No.: 97,961

[22] Filed: Jul. 26, 1993

[51] Int. Cl.[6] ..... B08B 15/02

[52] U.S. Cl. ..... 454/61

[58] Field of Search ..... 454/56, 57, 58, 59, 454/61

[56] References Cited

U.S. PATENT DOCUMENTS

| | | | |
|---|---|---|---|
| 4,040,042 | 8/1977 | Mayer . | |
| 4,464,653 | 8/1984 | Winner | 340/501 |
| 4,466,341 | 8/1984 | Grogan . | |
| 4,521,645 | 6/1985 | Carroll . | |
| 4,552,059 | 11/1985 | Potter . | |
| 4,557,184 | 12/1985 | Orii et al. . | |
| 4,706,553 | 11/1987 | Sharp et al. | 454/61 |
| 4,805,441 | 2/1989 | Sides et al. . | |
| 5,068,798 | 11/1991 | Heath et al. . | |
| 5,090,303 | 2/1992 | Ahmed | 454/238 X |
| 5,205,783 | 4/1993 | Diekert et al. | 454/59 X |

OTHER PUBLICATIONS

Anemostat Products Division/Dynamics Corporation of America. "Face Velocity Control Systems" brochure. 1984.

Yamato, "Clean Benche Model ADS-130 Series" brochure.

Anemostat Products Division/Dynamics Corporation of America, "Envirotrak-A Laboratory Air Flow Control System from Anemostat", Aug. 1985.

*Primary Examiner*—Harold Joyce

*Attorney, Agent, or Firm*—Greer, Burns & Crain, Ltd.

[57] ABSTRACT

A system for monitoring the operation of laboratory fume hoods is disclosed. The system includes a local area network for reporting alarm conditions and other data to a building supervisory control system. The system has a calibrating capability which is adapted to build a database of the operating parameters of the fume hood which can be used to detect any degradation of the operation of the fume hood.

21 Claims, 8 Drawing Sheets

NETWORKED FUME HOOD MONITORING SYSTEM

The present invention generally relates to the control of the ventilation of laboratory fume hoods, and more particularly to a networked monitoring system for such laboratory fume hoods.

Research and development work involving chemicals in a laboratory environment requires the use of fume hoods to confine the chemical fumes and thereby protect the individuals who are working in the laboratory. The fume hoods generally comprise an enclosure having a front opening and one or more movable doors adapted to cover the opening, but which can be opened to permit an individual to gain access to the interior of the enclosure for the purpose of performing experiments or other work. The enclosure is typically connected to a forced air exhaust system driven by a blower and the air from the fume hood is constantly being removed through the exhaust duct which carries any noxious fumes away so that an individual should not be exposed to the fumes while performing work in the hood.

Fume hood controllers which control the flow of air through the enclosure have become quite sophisticated in recent years and now are able to accurately maintain the desired flow characteristics to exhaust the fumes from the enclosure as a function of the desired average face velocity of the opening of the fume hood, regardless of the size of the uncovered opening. It should be understood that the volume of air that is required to maintain an average face velocity would necessarily have to increase as the opening is uncovered by moving the sash doors that are provided.

Fume hood controllers which accomplish this sophisticated operational control as well as other functions are disclosed in U.S. Pat. Nos. 5,090,303, 5,092,227, 5,115,728 and 5,090,304, all of which are assigned to the same assignee as the present invention. Fume hood controllers of the type disclosed in the aforementioned patents provide sophisticated control to maintain the face velocity relatively constant and do so by a combination of factors including a measurement of the position of the sash doors of the fume hood and a calculation of the uncovered area of the opening that results from the movement of the sash doors. The controller also controls the volume of air that is exhausted through the exhaust duct by either controlling the speed of a blower motor or by controlling the position of a damper located in the exhaust duct, either of which are effective to modulate the volume of air that is exhausted from the fume hood.

Such sophisticated controls are designed to provide the proper amount of flow to insure safety of the individuals who may be in the laboratory near the fume hoods, while also reducing to a minimum the amount of air that is expelled from the fume hoods and therefore the room. The less the amount of air removed from the room, the less air is necessary to replace the removed air. Obviously, if the fume hood is being operated during the winter and the replacement air has to be heated, substantial energy and therefore cost is required to heat the replacement air. Similarly, such energy considerations apply in cooling replacement air in the summer.

It is estimated that there are hundreds of thousands of fume hoods in existence in the United States at the present time and many of these fume hoods are installed without such sophisticated controllers. Many of these fume hoods are constant volume installations which remove a sufficient amount of air to maintain a safe condition regardless of whether the fume hood is opened or closed. While safety considerations are thereby satisfied when the fume hood is operating properly, more energy is expended in such an installation which results in increased operating costs. Because safety considerations are paramount, there is a need for monitoring systems for monitoring the operation of the fume hoods even if they are constant volume type of installations.

Accordingly, it is a primary object of the present invention to provide an improved monitoring system for laboratory fume hoods.

Another object of the present invention is to provide such an improved monitoring system that is networked to a building supervisory control system so that a building superintendent will be immediately alerted in the event of a potentially dangerous condition having occurred in the operation of a fume hood.

Still another object of the present invention lies in the provision for such a monitoring system which is relatively inexpensive in terms of its initial cost and installation, but which is effective to provide reliable information relating to the operation of the fume hood.

Another object of the present invention is to provide such an improved monitoring system which is effective to detect flow of air in the fume hood or in the exhaust duct connected to the fume hood, which is then processed to provide a face velocity value which can trigger alarm signals when the face velocity is outside of a predetermined bandwidth.

Yet another object of the present invention is to provide an improved monitoring system that also has the capability of determining the face velocity at a plurality of spaced locations in the opening of the fume hood, sending the data on a network to the building supervisory control system or other location, and then recording the data in a memory device to thereby build a database of operation of the fume hoods over time.

Other objects and advantages will become apparent upon reading the following detailed description, while referring to the attached drawings, in which.

Figure 2:
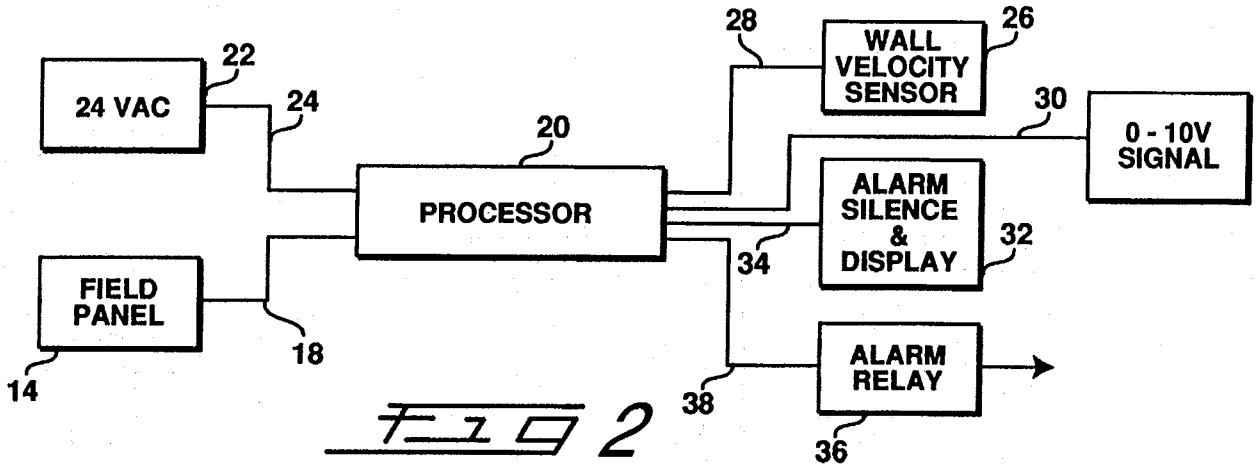
FIG. 2 is a schematic block diagram of one embodiment of the network fume hood monitoring system of the present invention.
Figure 3:
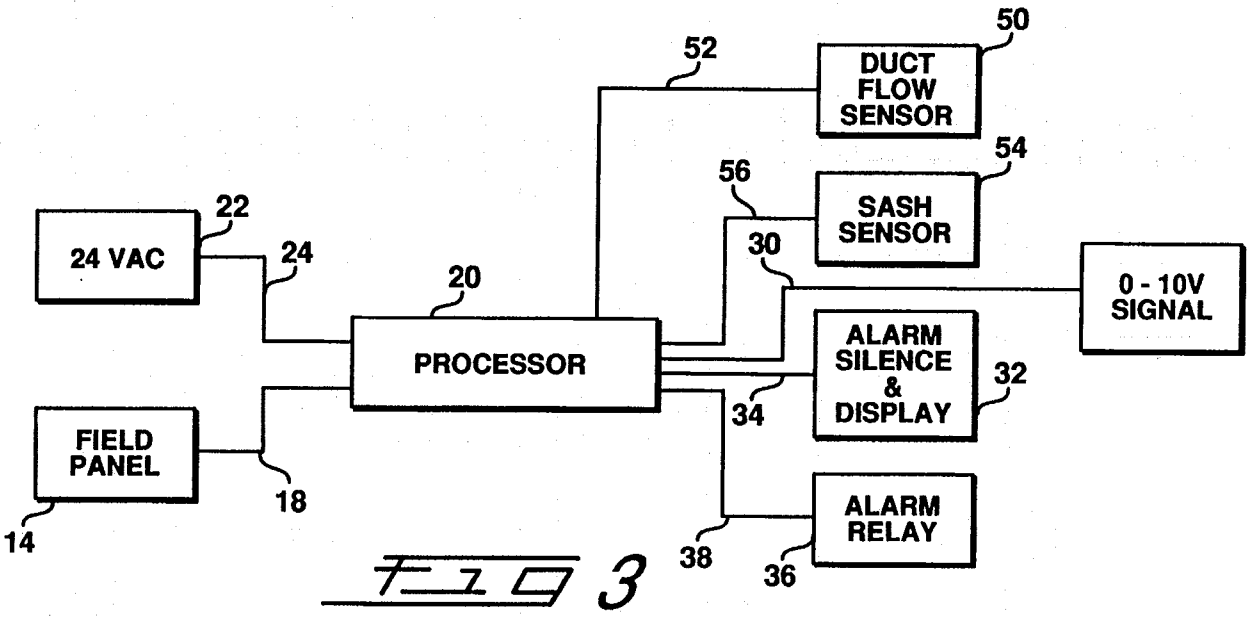
FIG. 3 is another embodiment of the networked fume hood monitoring system of the present invention.
Figure 7:
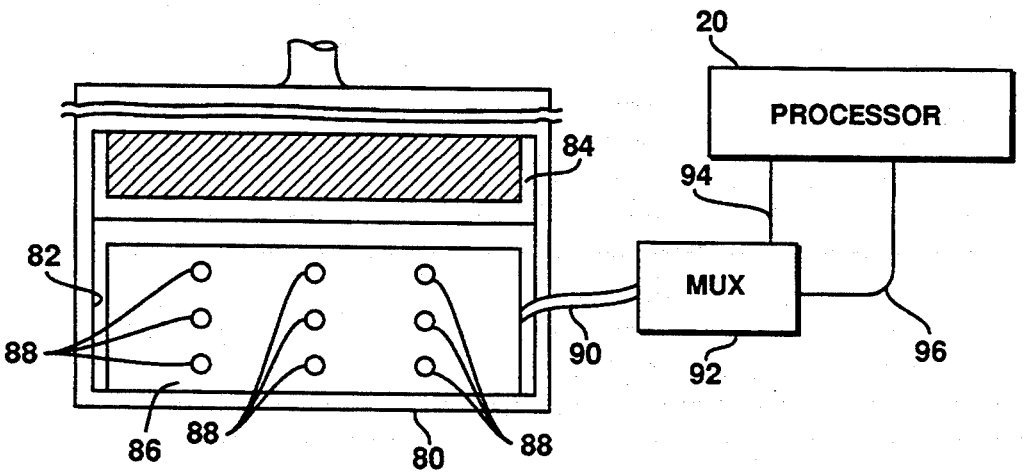

FIGS. 6*a*, 6*b*, 6*c*, 6*d* and 6*e* together comprise an electrical schematic diagram of specific circuitry that can be used to carry out the operation of the block diagram shown in FIGS. 2 or 3; and, FIG. 7 is a block diagram of an embodiment for performing a calibration traverse of the opening of a fume hood for use in building a database of the performance of individual fume hoods.

DETAILED DESCRIPTION

Broadly stated, the present invention is directed to a monitoring system for laboratory fume hoods which includes a communication capability for networking the monitored information to a central location, such as a building supervisory control system. Such a supervisory control system operates to control the heating, ventilating, and air conditioning equipment of the building as well as other possible functions.

The system of the present invention is adapted to monitor the flow of air through an exhaust duct to which the fume hood is connected or to detect the differential pressure between the inside of the fume hood and the outside thereof or measure a representative sample of the flow of air from the room into the fume hood. This can be accomplished by means of a differential pressure sensor or a through-the-wall sensor which produces a signal that is indicative of the face velocity of the fume hood during operation. The system then calculates the face velocity and by means of a processing means, calculates a bandwidth of values which represents a safe operating range for the fume hood.

In the event that the calculated face velocity exceeds an upper value or falls below a lower predetermined value, the system issues an alarm signal which can trigger a local alarm or a central alarm if desired and also communicate the alarm condition to the building supervisory control system via the network communication link.

While the preferred embodiment for the communication link is a two wire connection from the fume hood monitoring system to the building supervisory control system or other central location, other types of communication links are also within the scope of the present invention and may include multiple wire communication links, i.e., in excess of two wires, a fiber optic communication link, a coaxial connection, and even wireless communication, such as an RF transmission link or an infrared radiation communication link.

The monitoring system preferably has a display module which can be installed on the fume hood and the display module preferably provides a numerical indication of the face velocity of the hood, an audible alarm as well as an alarm light. The display module also preferably has an audible alarm silencing pushbutton which enables an individual to turn off the alarm. This event is also preferably applied to the network for communication to the building supervisory control system provides an alarm acknowledgement signal to the supervisory control system. Such an acknowledgement signal indicates that someone is present in the laboratory and is aware of the alarm condition at the local level.

The system is also adapted to provide a plurality of face velocity signals in a face velocity traverse operation which is typically done 4 times a year. The readings taken at various spaced apart locations within the fume hood opening, preferably at least nine locations, and these values are then communicated on the local area network to a memory device where a database of fume hood performance is accumulated over time. The database provides a baseline for operation and enables individuals to detect degradation of the operation of particular fume hoods, so that maintenance can be performed.

Figure 1:
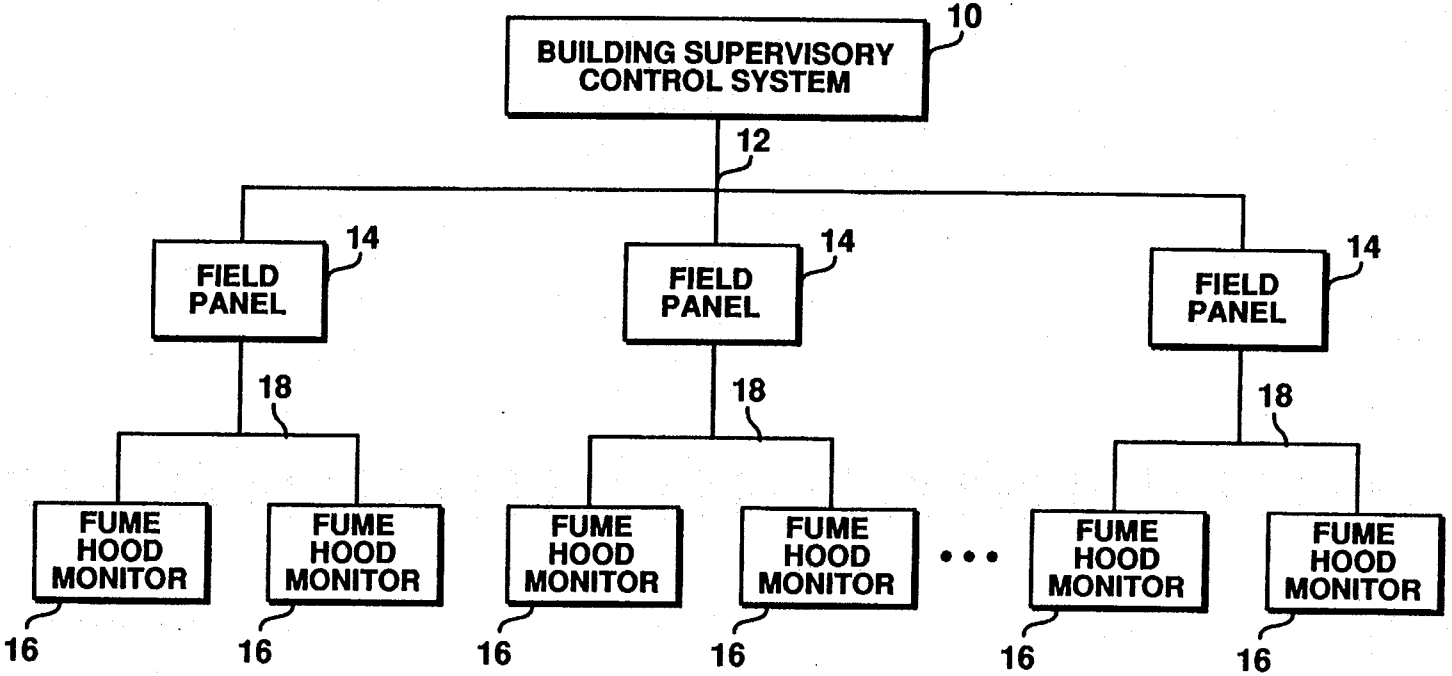
FIG. 1 is a schematic block diagram of a building supervisory control system shown together with a number of fume hood monitoring systems embodying the present invention.

Turning now to the drawings, and particularly FIG. 1, there is shown an overall schematic block diagram of a building supervisory control system, indicated generally at 10, which preferably has a central control console (not shown) with a computer which is typically manned by an operator and controls the building heating, ventilating and air conditioning equipment and sometimes fire alarm, security and other systems that may be provided in the building.

The system 10 has a local area network (LAN) indicated generally by line 12 that extends to field panels 14 that are typically located throughout the building for interconnecting the system 10 to the HVAC equipment, such as dampers and the like, that are located in the building. Since the present invention monitors laboratory fume hoods, the building quite likely has one or more laboratory rooms having fume hoods installed in the rooms. There are a number of fume hood monitors 16 shown in FIG. 1 which are connected to the field panel via the local area network line 18 which extends from the monitoring system of the present invention to the field panel. By virtue of the local area network lines 12, the monitoring system is also connected to and in communication with the building and supervisory control system 10.

One embodiment of the monitoring system of the present invention is shown in FIG. 2 and includes a processor 20 that is powered by a 24 volt a.c. source 22 via line 24 and the processor has the LAN connection 18 to the field panel 14 in the manner previously described in connection with FIG. 1. The processor 20 is also connected to a wall velocity sensor 26 via line 28 and receives a signal that is representative of the face velocity in the form of an analog voltage signal that is applied to the processor 20 which converts it to a digital signal for processing. The wall velocity sensor 26 identified in FIG. 2 is preferably a through the wall sensor, but can be a differential pressure sensor. The processor 20 also provides an analog output signal on line 30 which is preferably in the range of 0 to 10 volts for use with a fume hood controller or some other non-networked control device, such as a unitary controller for controlling the temperature and/or pressure in the room in which the fume hood is located, for example. The processor 20 is also connected to a display module 32 via line 34 and the display module is adapted to display the face velocity as well as other conditions to be described. Provision is also made for providing an alarm relay signal shown at 36 which is connected to the processor via line 38 and this alarm relay may be used to operate an auxiliary central or local alarm.

Figure 4:
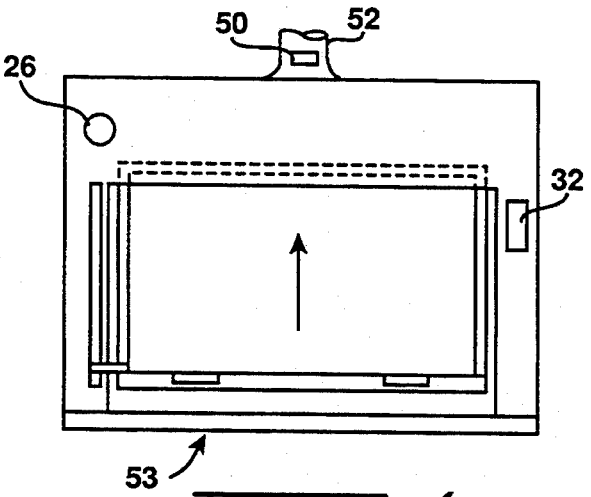
FIG. 4 is a front view of a fume hood having a single vertically movable sash which is representative of fume hoods in which the present invention may be installed.

The wall velocity sensor 26 is preferably a through-the-wall sensor, but can be a differential pressure sensor as previously stated, which is installed on the fume hood at a location as shown in FIG. 4, with the through-the-wall velocity sensor or differential pressure sensor requiring an opening in the wall of the fume hood and means for measuring the flow or pressure of the outside relative to the inside of the fume hood. Of course, it should be understood that the location of the sensor 26 may be at the location shown or at some other location on the hood. Such an indication is representative of the face velocity of the fume hood when it is in a steady state condition. When flow rates change rapidly, such as if the sash door is opened, then the through-the-wall sensor or differential pressure sensor is not particularly accurate until it has reached a steady state condition.

Through-the-wall sensors of the type that are preferred, are also known as anemometers, and generally comprise a pair of temperature dependent resistive elements or thermistors, one of which is generally heated a predetermined value above the ambient temperature. The heated element is thereby cooled by air flow at a rate that is proportional to the flow rate, and the power required to maintain the heated element at the elevated temperature provides an electrical signal that is representative of the flow rate. Such anemometer sensors are available from Fenwall, Alpha Thermistors, TSI, Jurz and Sierra. Differential pressure transmitters in the range of 0.0015 and 0.0016 inches of water may also be used and are available from Air Monitor and MKS.

With the embodiment of FIG. 2, the processor 20 monitors the signal from the sensor 26 and after calibration is able to determine upper and lower limits which establish a bandwidth defining a safe operating range. The lower face velocity is preferably approximately 60 feet per minute and the upper limit is approximately 500 feet per minute. As long as the face velocity is within these limits, then it is considered to be safe. If the face velocity falls below 60 feet per minute or exceeds 500 feet per minute, then the processor 20 will issue an alarm signal on lines 34 and 38 which will cause an audio alarm and also a visual alarm to occur. It should be apparent that both an audio and visual alarm is not absolutely necessary, but is preferred.

Figure 5:
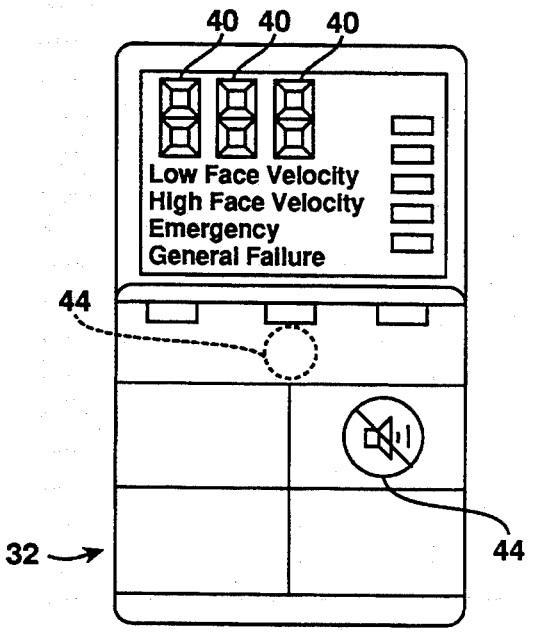
FIG. 5 is a front view of a display that may be provided at the fume hood, which display is a part of the present invention.

The display module 32 is shown in FIG. 5 and preferably has a three digit LCD display indicated at 40 as well as a "low face velocity" readout, a "high face velocity" readout, an "emergency" readout and a "general failure" readout. In addition to displaying the face velocity numerically, an alarm condition produced by either a high or low face velocity results in one of these indicators to be illuminated. The display module 32 also has an alarm horn indicated at 42 and an alarm silence pushbutton 44 located on the display. If the horn is being sounded and an operator is present and knows what is occurring, the operator can push the button 44 to expel the alarm. By operating the pushbutton 44, a signal is thereby sent to the processor 20 which communicates that data to the field panel and to the supervisory control system 10 so that an acknowledgement of the alarm condition is provided.

The processor 20 preferably communicates information on the local area network lines 18 which includes an address identifying the particular fume hood that is sending the information, data indicating an alarm condition if that event has occurred, as well as the face velocity in a digital signal representing feet per minute. It also will provide the alarm acknowledgement signal as well as a signal indicating the value of the voltage of the velocity sensor or differential pressure sensor itself.

The processor is adapted to be able to calibrate the wall velocity sensor or the differential pressure sensor if it is used, and depending upon the particular fume hood, a one volt signal may be representative of 60 feet per minute or it may be 100 feet per minute. In any event, the calibration is straightforward and can be relatively easily accomplished by one of ordinary skill in the art.

Another embodiment of the present invention is shown in FIG. 3 and it has similar components such as the processor 20, line 24, the analog signal on line 30, the 24 volt a.c. source 22, the field panel 14 and LAN connection 18 as well as the alarm silence and display 32, the alarm relay 36 and lines 38 and 34. However, there is no through-the-wall sensor 26 or fume hood differential pressure sensor in this embodiment, but rather a duct flow sensor 50 that is connected to the processor via line 52 and a sash sensor 54 that is connected to the processor via line 56.

The sash sensor represented by the block 54 may in fact be a single sash sensor or a multiple sash sensor as disclosed in the aforementioned U.S. Pat. No. 5,090,304 patent and the U.S. Pat. No. 5,170,673 patent. The sash sensor signals are received by the processor 20 and it is adapted to calculate the area of the uncovered opening of the fume hood.

Referring to FIG. 4, the duct flow sensor 50 is located in an exhaust duct 52 of the illustrated fume hood, indicated generally at 53, and the duct flow sensor 50 provides a differential pressure measurement that can be used to calculate the volume of air of the fume hood. The range of the sensor 50 is preferably about 0.5 to 1.0 inch water column. More particularly, the duct velocity is the square root of the differential pressure measurement multiplied by a scaling constant and this duct velocity is then multiplied by the duct area to calculate the air volume through the fume hood. Using the sash sensor inputs, an open face area can be calculated, and by using the following equation, a face velocity can be derived: face velocity=air volume/face area. If the sash sensors are not used, then a flow sensor can be used by itself to monitor the flow through the fume hood. Without the sash sensors, a face velocity cannot be displayed but alarms can be triggered for flow rates that are too high or too low.

The differential pressure measurement is typically an inches of water column reading with an output of preferably 4 to 20 milliamps and it is applied to the processor 20. The processor 20 shown in this embodiment also preferably provides a safe operating bandwidth and also issues an alarm signal if the face velocity falls below the 60 foot per minute value or exceeds the 500 foot per minute value.

If an alarm condition occurs, that is sent on the local area network communication link 18 as is the duct velocity signal itself, the duct diameter, the address of the fume hood and also an application number which preferably indicates whether the control of the fume hood is being accomplished by a variable speed drive controlling the blower or by controlling the position of a damper in the exhaust.

Figure 6B:
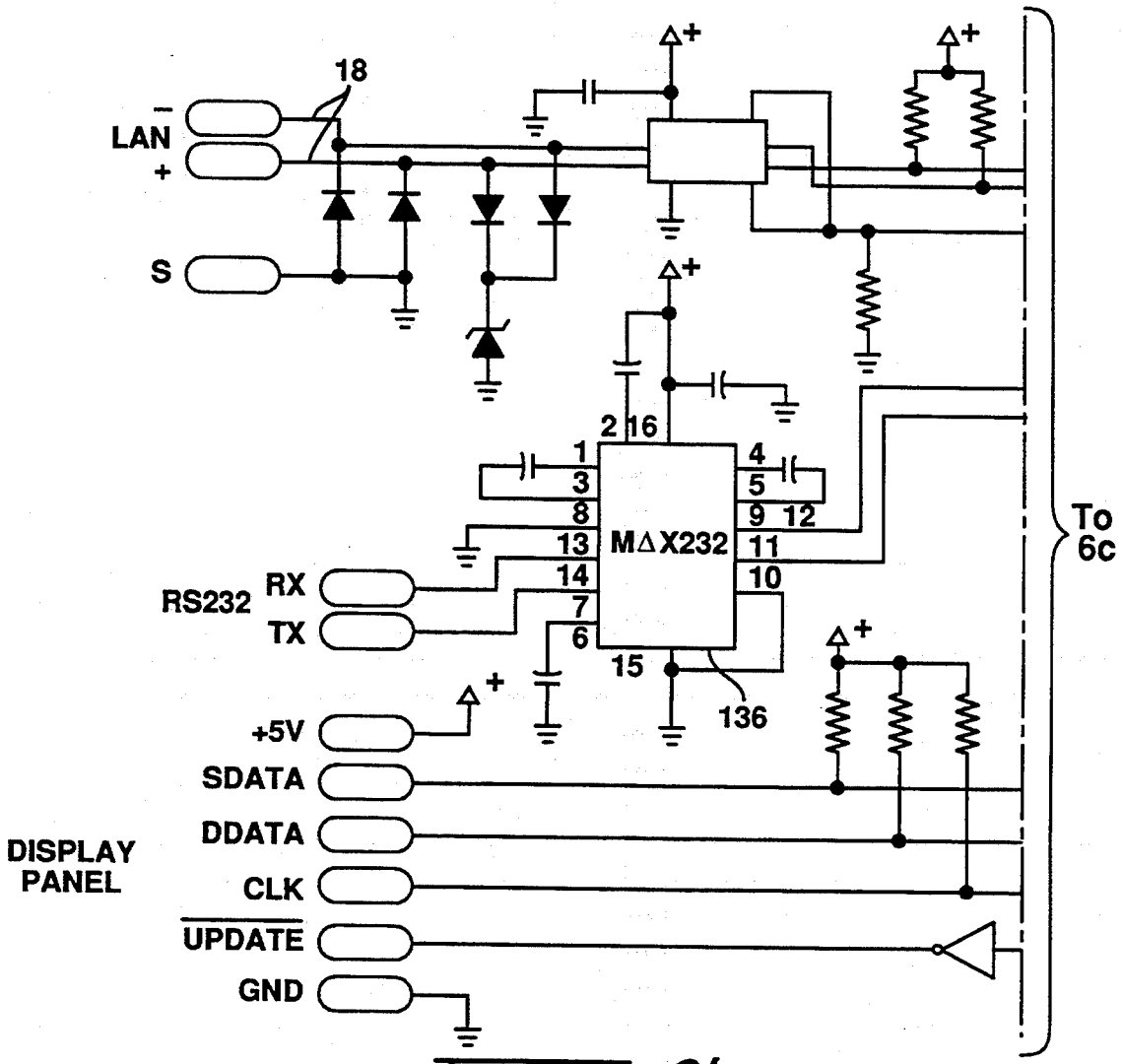
FIG. 6 is a schematic illustration of the matter in which FIGS. 6*a* through 6*e* can be combined to form a single electrical schematic diagram.
Figure 6:
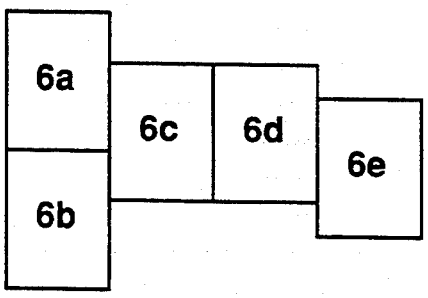
Figure 6A:
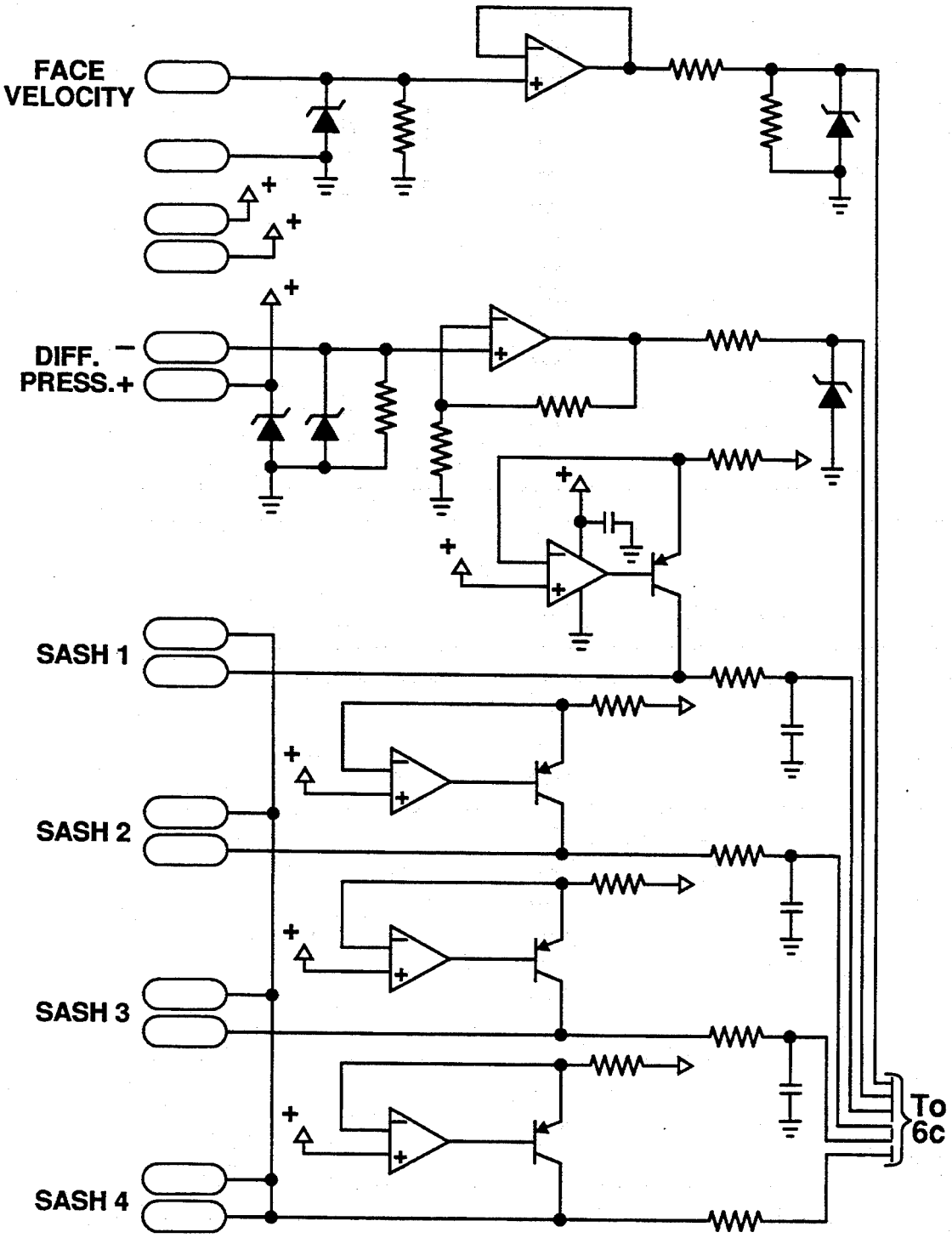
Figure 6C:
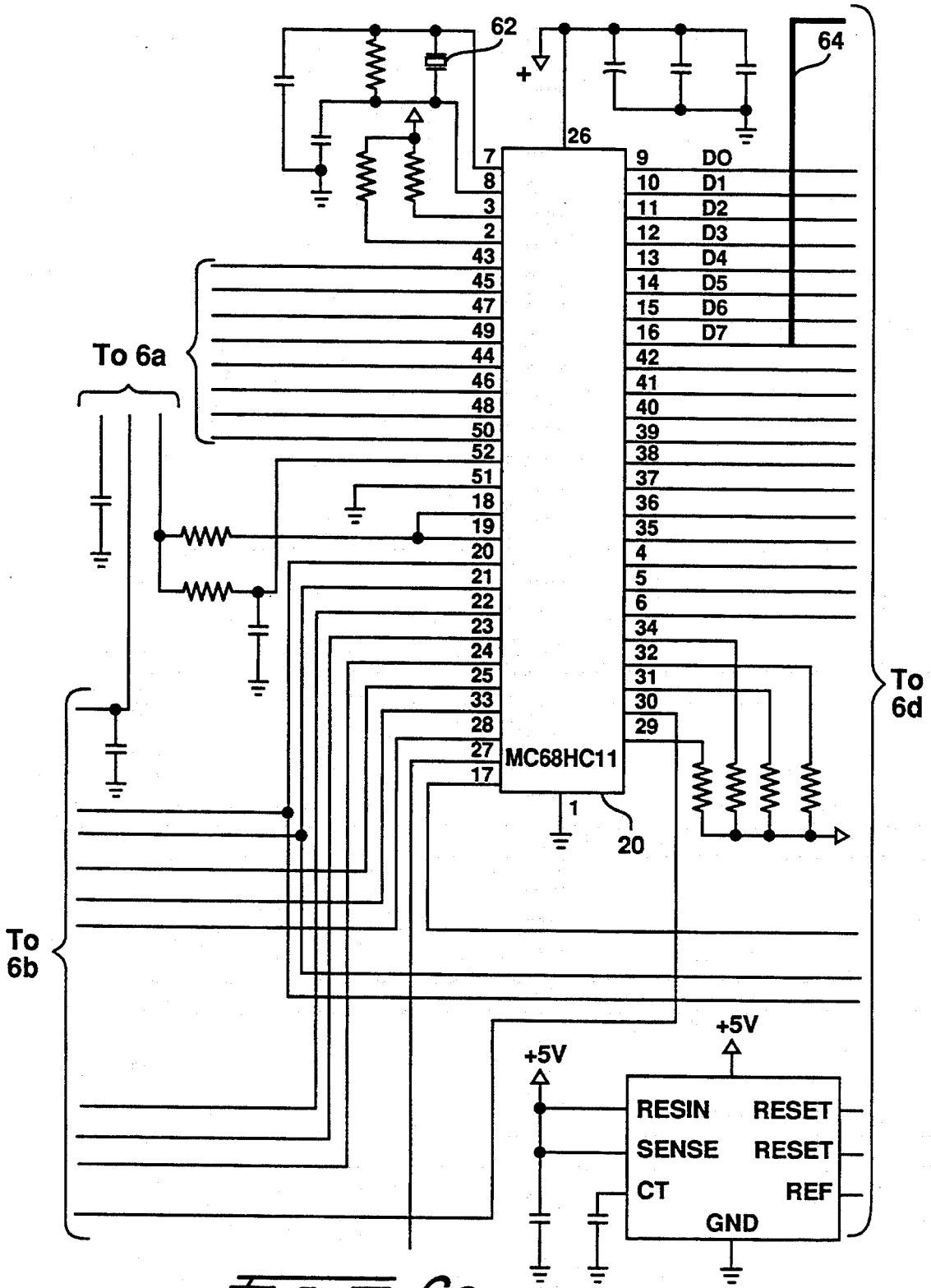
Figure 6D:
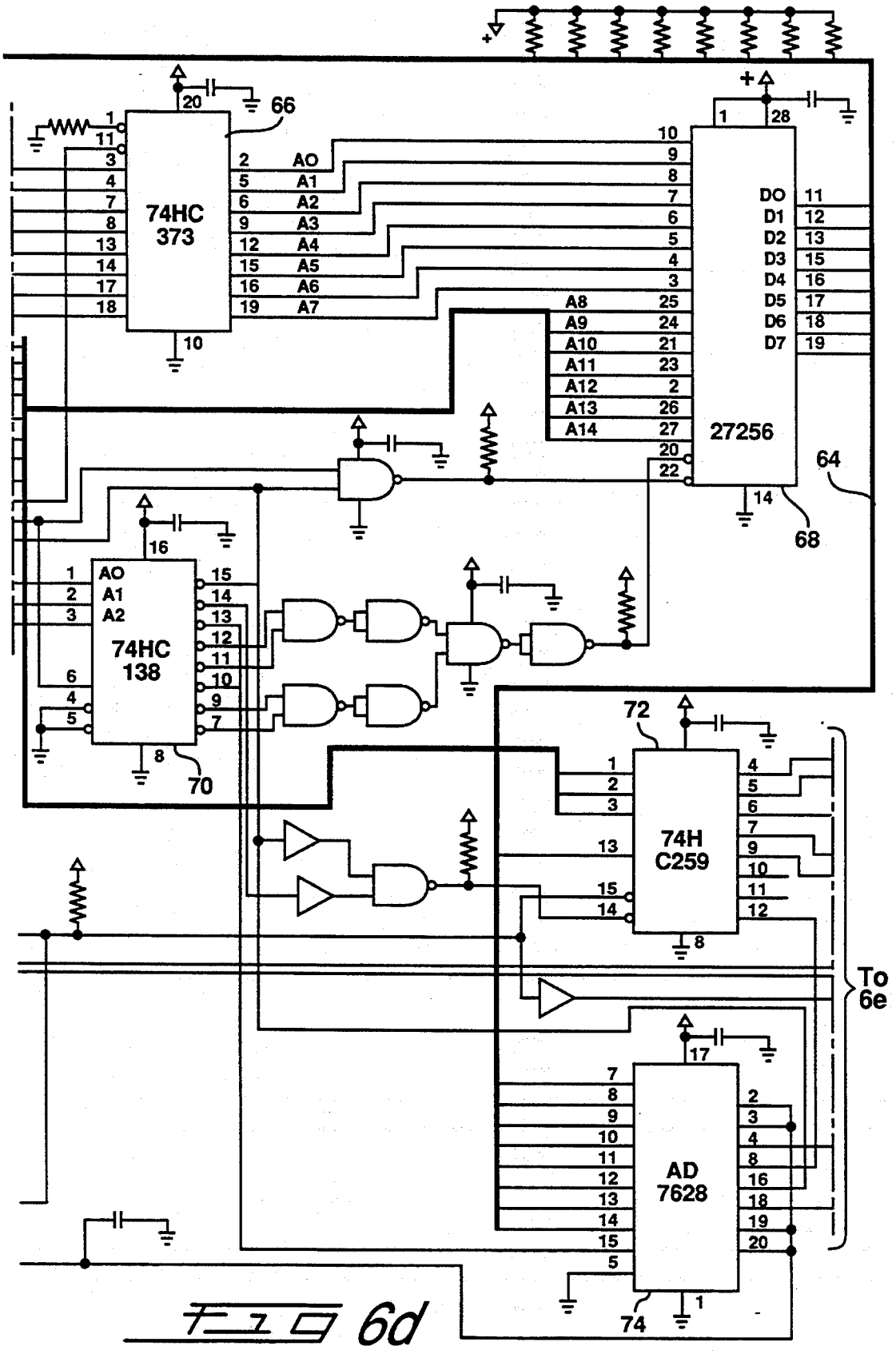
Figure 6E:
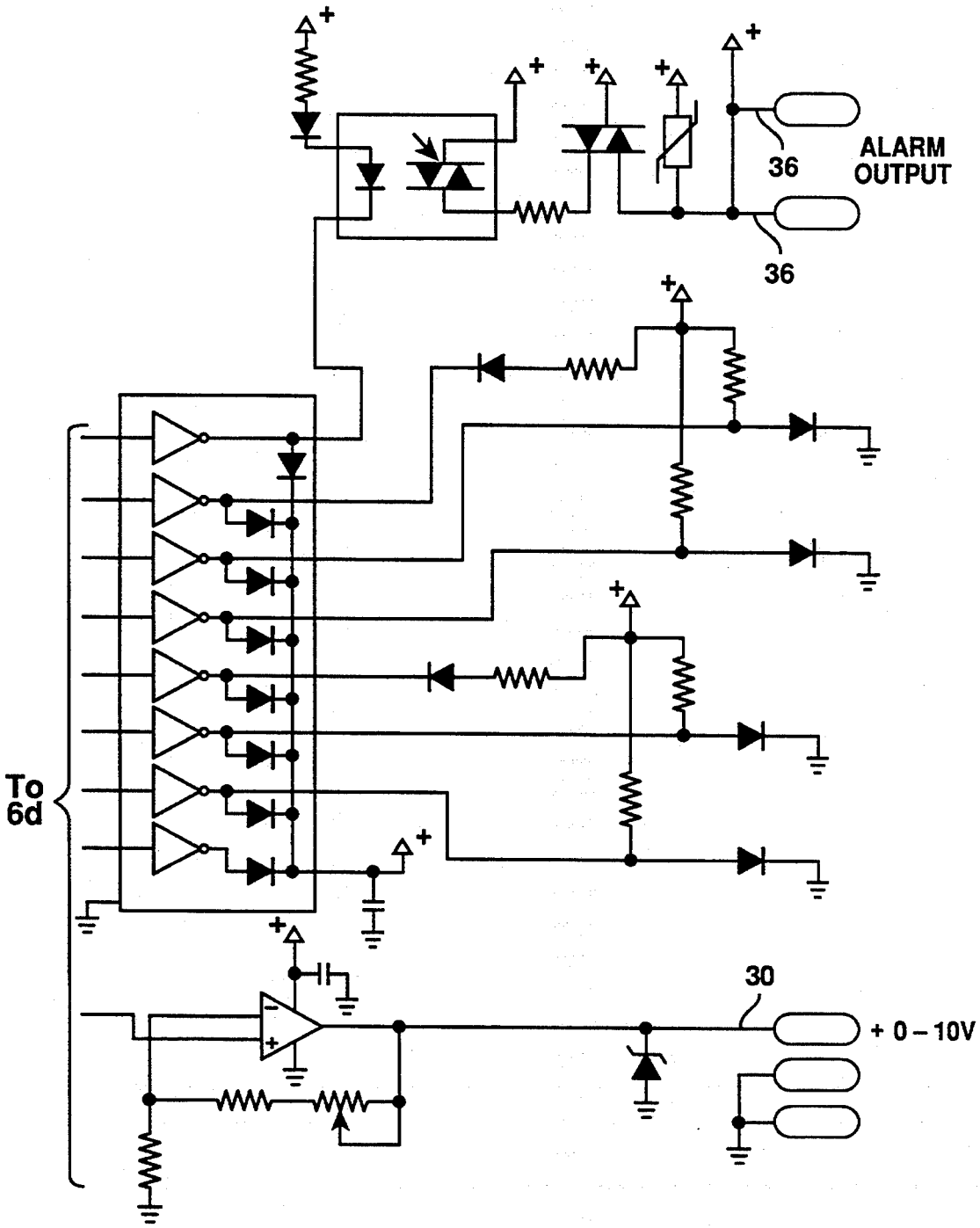

Referring to the composite electrical schematic diagram of the circuitry of the fume hood monitoring system, if the separate drawings FIGS. 6*a*, 6*b*, 6*c*, 6*d* and 6*e* are placed adjacent one another in the manner shown in FIG. 6, the total electrical schematic diagram of the fume hood controller is illustrated. The circuitry is driven by a microprocessor 20 as shown in FIG. 6*c* which is preferably a Motorola MC68HC11 which is preferably clocked at 8 MHz by a crystal 62. The microprocessor 20 has a databus 64 that is connected to a tri-state buffer 66 (see FIG. 6*d*) which in turn is connected to an electrically programmable read only memory 68 that is also connected to the databus 64. The EPROM 68 has address lines A0 through A7 connected to the tri-state buffer 66 and also has address lines A8 through A14 connected to the microprocessor 20. The circuitry includes a three-to-eight bit multiplexer 70, a data latch 72, and a digital-to-analog converter 74 which is adapted to provide the auxiliary 0 to 10 volt analog output on line 30.

In accordance with another important aspect of the present invention, the monitoring system of the present invention is also adapted to provide another feature for the fume hoods and that is to calibrate and perform maintenance of the fume hood and also to utilize the local area network to build a database of the operation of each fume hood for use in determining whether the fume hood is operating properly or is experiencing degradation in its operation.

It is common practice to perform a face velocity traverse of the fume hood to indicate whether the fume hood is operating safely. Such a traverse is used on both constant volume and variable volume fume hoods and is typically performed at intervals of approximately three months.

Referring to FIG. 7, a fume hood 80 is shown and it has an opening 82 that has a sash door 84 present but in a raised position. Within the uncovered portion of the opening is a sensor grid structure 86 that has a total of 9 sensors 88 positioned in a matrixed arrangement.

Velocity measurements are taken at preferably at least nine locations in the fume hood opening, with none of the probes being closer than approximately six inches from any edge of the opening. By taking nine simultaneous measurements, any unevenness in the flow can be detected and recorded. It is typical to average the velocity values over a period of time, for example, 10 to 15 seconds. The signals from each of the probes are applied on lines 90 which extend to a multiplexing switch 92 controlled by the processor 20 via line 94 for sequentially applying the signals from each sensor 88 to the processor 20 through a serial port via line 96. Alternatively, a separate processor can be utilized to receive the velocity signals from the various sensors 88, which can then average them and then apply them to the processor 20.

The processor 20 is then adapted to send these velocity signals to the supervisory control system 10 which preferably receives them and records them in memory to thereby provide a database over time indicating the performance of the fume hood. Not only does the data provide a record of performance of each fume hood, inspection of the data over time which may indicate there is a degrading of the fume hood operation that can be used by maintenance people to make any necessary modifications or corrections. It may be that a belt on a blower may be slipping or a filter may be loaded to the extent that air flow through it is impaired, for example. The data may provide a history of performance and maintenance that may become important in a legal proceeding in the event that damage or injury occurs in the laboratory.

From the foregoing, it should be appreciated that a superior monitoring system has been shown and described which has the capability of monitoring the face velocity and flow of the fume hoods during operation and can trigger alarm conditions in the event that the detected or monitored face velocity or flow goes outside of a predetermined safety bandwidth of values. The monitoring system has the advantage in that it is inexpensive in terms of its initial cost as well as installation, yet it has the capability of reporting relevant information relating to the operation of the fume hoods to a central location, such as a building supervisory control system. The monitoring system also has the ability to perform calibration and status checks of a plurality of points in the fume hood opening and this information can be sent on the local area network to a central repository where it can be recorded in memory and be used to provide a record of the operation of the fume hood which can be important in detecting degradation of the operation of the fume hood.

While various embodiments of the present invention have been shown and described, it should be understood that various alternatives, substitutions and equivalents can be used, and the present invention should only be limited by the claims and equivalents thereof.

Various features of the present invention are set forth in the following claims.

What is claimed is:

1. Apparatus for monitoring the operation of a fume hood which is operable to maintain a flow of air through the fume hood, including any uncovered portion of an opening of a fume hood of the type which has at least one moveable sash door adapted to selectively cover and uncover the opening during movement thereof, the fume hood being in communication with an exhaust duct for expelling air and fumes from the fume hood, the fume hood being located in a building having a supervisory control system for controlling the building heating, ventilating and air conditioning equipment, said apparatus being adapted to generate signals that are indicative of the monitored operation, said apparatus comprising:

velocity sensing means for measuring the flow of air through the fume hood and generating a flow signal that is indicative of the flow of air through the fume hood;

an alarm means and a switch of expelling said alarm means if said alarm means is activated;

processing means for generating a face velocity signal indicative of the average face velocity responsive to said flow signal;

said processing means being adapted to generate an identification signal which identifies the fume hood which the apparatus is monitoring during operation;

said processing means including means for specifying a bandwidth defined by a predetermined minimum face velocity signal and a predetermined maximum face velocity signal;

said processing means being adapted to generate an alarm signal responsive to said face velocity signal being outside of said bandwidth;

said processing means being adapted to generate an alarm acknowledgement signal responsive to an operator actuating said alarm expel switch;

means for communicating said identification signal, said face velocity signal, any alarm signal and any alarm acknowledgement signal to the building supervisory control system.

2. Apparatus as defined in claim 1 wherein said velocity sensing means is located in an outer wall of the fume hood and is adapted to measure the differential pressure of the outside relative to the inside of the fume hood.

3. Apparatus as defined in claim 2 herein said velocity sensing means comprises an aperture in the outer wall of the fume hood and an anemometer means adapted to generate an electrical signal that is proportional to the flow of air from one side of said wall relative to the other side thereof, said air flow being proportional to the face velocity of flow through the uncovered portion of the fume hood opening.

4. Apparatus as defined in claim 2 wherein said velocity sensing means comprises an aperture in the outer wall of the fume hood and a differential pressure means adapted to generate an electrical signal that is proportional to the differential pressure on one side of said wall relative to the other side thereof, said differential pressure being proportional to the face velocity of flow through the uncovered portion of the fume hood opening.

5. Apparatus as defined in claim 1 wherein said processing means is adapted to generate and does generate signals that are indicative of the type fume hood that is being monitored, said communicating means communicating said signals to the building supervisory control system.

6. Apparatus as defined in claim 1 wherein said alarm is a visual display.

7. Apparatus as defined in claim 6 wherein said alarm is an audio alarm.

8. Apparatus as defined in claim 1 wherein said predetermined minimum value is approximately 60 feet per minute.

9. Apparatus as defined in claim 1 wherein said predetermined maximum value is approximately 500 feet per minute.

10. Apparatus as defined in claim 1 wherein said communicating means comprises a two wire local area network.

11. Apparatus as defined in claim 1 wherein said communicating means comprises a fiber optic cable.

12. Apparatus as defined in claim 1 wherein said communicating means comprises a wireless transmission link.

13. Apparatus for monitoring the operation of a fume hood which is operable to maintain a flow of air through the fume hood, including any uncovered portion of an opening of a fume hood of the type which has at least one moveable sash door adapted to selectively cover and uncover the opening during movement thereof, the fume hood being in communication with an exhaust duct for expelling air and fumes from the fume hood, the fume hood being located in a building having a supervisory control system for controlling the building heating, ventilating and air conditioning equipment, said apparatus being adapted to generate signals that are representative of the monitored operation, said apparatus comprising:

means for determining the position of each independently moveable sash door and generating a position signal that is indicative of the position thereof;

means for measuring the flow of air through the exhaust duct and generating a flow signal that is indicative of the flow of air through the exhaust duct;

an alarm means and a switch for expelling said alarm means if said alarm means is activated;

processing means for determining the size of the uncovered portion of said opening responsive to said position signals and for generating a face velocity signal proportional to the average face velocity responsive to said position signals and said flow signal;

said processing means including means for specifying a bandwidth defined by a predetermined minimum face velocity signal and a predetermined maximum face velocity signal, said processing means;

said processing means being adapted to generate an alarm signal responsive to said face velocity signal being outside of said bandwidth;

said processing means being adapted to generate an identification signal which identifies the type of fume hood as well as the particular fume hood which the apparatus is monitoring during operation;

said processing means being adapted to generate an alarm acknowledgement signal responsive to an operator actuating said alarm expel switch;

means for communicating said identification signal, said face velocity signal, any alarm signal and any alarm acknowledgement signal to the building supervisory control system.

14. Apparatus as defined in claim 13 wherein said predetermined minimum value is approximately 60 feet per minute.

15. Apparatus as defined in claim 13 wherein said predetermined maximum value is approximately 500 feet per minute.

16. Apparatus as defined in claim 13 wherein said exhaust duct flow measuring means comprises means for measuring the differential pressure within said exhaust duct and providing a signal indicative thereof to said processing means.

17. Apparatus as defined in claim 16 wherein said processing means generates a face velocity signal by multiplying the square root of said differential pressure indicative signal by a constant and by the area of said exhaust duct.

18. Apparatus for monitoring the operation of a fume hood which is operable to maintain a flow of air through the fume hood, including any uncovered portion of an opening of a fume hood of the type which has at least one moveable sash door adapted to selectively cover and uncover the opening during movement thereof, the fume hood being in communication with an exhaust duct for expelling air and fumes from the fume hood, the fume hood being located in a building having a supervisory control system for controlling the building heating, ventilating and air conditioning equipment, the supervisory control system having a memory means associated therewith, said apparatus being adapted to generate signals that are representative of the monitored operation, said apparatus comprising:

a plurality of velocity sensing means for measuring for a period of time the instantaneous face velocity of air at a plurality of spaced apart locations in a largely uncovered opening of the fume hood and generating a plurality of face velocity signals that are indicative of the face velocity of flow of air through the uncovered opening of the fume hood at each of said locations;

processing means for generating an average face velocity signal for each of said plurality of locations;

said processing means being adapted to generate an identification signal which identifies the fume hood which the apparatus is monitoring during operation;

means for communicating said identification signal, said face velocity signals to the building supervisory control system; and, the supervisory control system receiving said face velocity signals and storing the same in the memory means associated therewith said stored values thereafter comprising a database for providing a baseline for operation of particular fume hoods.

19. Apparatus as defined in claim 18 wherein said memory means is located in the supervisory control system of the building, said apparatus further including means for communicating said average face velocity signals to the building supervisory control system.

20. Apparatus as defined in claim 18 wherein said plurality of velocity sensing means comprises at least 9, said locations being configured in a matrix within said uncovered portion of the opening, none of the locations being closer than approximately six inches from the perimeter of the uncovered portion of the opening.

21. Apparatus for monitoring the operation of a fume hood which is operable to maintain a flow of air through the fume hood, including any uncovered portion of an opening of a fume hood of the type which has at least one moveable sash door adapted to selectively cover and uncover the opening during movement thereof, the fume hood being in communication with an exhaust duct for expelling air and fumes from the fume hood, the fume hood being located in a building having a supervisory control system for controlling the building heating, ventilating and air conditioning equipment, said apparatus being adapted to generate signals that are representative of the monitored operation, said apparatus comprising:

means for measuring the flow of air through the exhaust duct and generating a flow signal that is indicative of the flow of air through the exhaust duct;

processing means for generating a face velocity signal proportional to the average face velocity responsive to said flow signal, said processing means including means for specifying a bandwidth defined by a predetermined minimum face velocity signal and a predetermined maximum face velocity signal, said processing means being adapted to generate an alarm signal responsive to said face velocity signal being outside of said bandwidth;

said processing means including means for generating an identification signal which identifies the type of fume hood as well as the particular fume hood which the apparatus is monitoring during operation;

means for communicating said alarm signal and said identification signal to the building supervisory control system.

* * * * *